US010750786B2

(12) United States Patent
Yener

(10) Patent No.: US 10,750,786 B2
(45) Date of Patent: Aug. 25, 2020

(54) ELECTRONIC SMOKING DEVICE WITH SECONDARY HEATING ELEMENT

(71) Applicant: Fontem Holdings 1 B.V., Amsterdam (NL)

(72) Inventor: Emin Yener, Hamburg (DE)

(73) Assignee: Fontem Holdings 1 B.V., Amsterdam (NL)

( * ) Notice: Subject to any disclaimer, the term of this patent is extended or adjusted under 35 U.S.C. 154(b) by 156 days.

(21) Appl. No.: 15/567,561

(22) PCT Filed: Apr. 11, 2016

(86) PCT No.: PCT/EP2016/057875
§ 371 (c)(1),
(2) Date: Oct. 18, 2017

(87) PCT Pub. No.: WO2016/169796
PCT Pub. Date: Oct. 27, 2016

(65) Prior Publication Data

US 2018/0103685 A1 Apr. 19, 2018

(30) Foreign Application Priority Data

Apr. 22, 2015 (EP) ..... 15164619

(51) Int. Cl.
*A24F 13/00* (2006.01)
*A24F 17/00* (2006.01)
(Continued)

(52) U.S. Cl.
CPC ..... *A24F 47/008* (2013.01); *A24F 7/02* (2013.01); *H05B 3/04* (2013.01); *H05B 3/06* (2013.01)

(58) Field of Classification Search
CPC ..... A24F 47/00; A24F 47/008; A61M 15/06
(Continued)

(56) References Cited

U.S. PATENT DOCUMENTS 8,794,231 B2 * 8/2014 Thorens ..... A24D 3/18 128/202.21
10,426,199 B2 * 10/2019 Turner ..... A24F 47/008
(Continued)

FOREIGN PATENT DOCUMENTS

CN 203378558 U 1/2014
CN 203748667 * 8/2014 ..... A24F 47/00
(Continued)

OTHER PUBLICATIONS

British combined search and examination report under Sections 17 and 18(3), dated Jun. 30, 2015, pp. 1-7.
(Continued)

*Primary Examiner* — Abdullah A Riyami
*Assistant Examiner* — Thang H Nguyen
(74) *Attorney, Agent, or Firm* — Dykema Gossett PLLC

(57) ABSTRACT

It is provide an electronic smoking device (10) which comprises a mouthpiece (15) at a first end (40) of the electronic smoking device (10), wherein the mouthpiece (15) comprises an air inhalation port (36). Furthermore, the electronic smoking device (10) comprises an atomizer (26) with a primary heating element (27) and a liquid reservoir (34). A secondary heating element (60) is provided inside the electronic smoking device (10) at the first end (40) of the electronic smoking device (10). Furthermore, a mouthpiece (15) for an electronic smoking device (10) is provided, comprising a body (19) with an air inhalation port (36) therein. The mouthpiece (15) comprises a secondary heating element (60) which is arranged within the body (19).

9 Claims, 10 Drawing Sheets

(51) Int. Cl.

| | |
|---|---|
| ***A24F 25/00*** | (2006.01) |
| ***A24F 47/00*** | (2020.01) |
| ***A24F 7/02*** | (2006.01) |
| ***H05B 3/04*** | (2006.01) |
| ***H05B 3/06*** | (2006.01) |

(58) Field of Classification Search
USPC ..... 439/329
See application file for complete search history.

(56) References Cited

U.S. PATENT DOCUMENTS

| | | | | |
|---|---|---|---|---|
| 2008/0092912 | A1* | 4/2008 | Robinson | A24B 15/167 131/200 |
| 2014/0182609 | A1* | 7/2014 | Liu | A24F 47/008 131/329 |
| 2014/0261495 | A1* | 9/2014 | Novak, III | A61M 11/042 131/329 |
| 2014/0366898 | A1* | 12/2014 | Monsees | A24F 47/008 131/329 |
| 2015/0059787 | A1* | 3/2015 | Qiu | H05B 3/14 131/329 |
| 2016/0183592 | A1* | 6/2016 | Liu | H05B 1/0244 131/329 |
| 2016/0302488 | A1* | 10/2016 | Fernando | A24F 40/50 |
| 2017/0280775 | A1* | 10/2017 | Manca | A24F 47/008 |
| 2017/0347706 | A1* | 12/2017 | Aoun | F22B 1/284 |
| 2019/0045834 | A1* | 2/2019 | Fuisz | A24B 15/241 |
| 2019/0083720 | A1* | 3/2019 | Leadley | A61M 11/042 |
| 2019/0124982 | A1* | 5/2019 | Atkins | A61M 11/042 |
| 2019/0150520 | A1* | 5/2019 | Fraser | A61M 11/042 |

FOREIGN PATENT DOCUMENTS

| | | | |
|---|---|---|---|
| CN | 203748667 | U | 8/2014 |
| EP | 0430559 | A2 | 6/1991 |
| EP | 2113178 | A1 | 11/2009 |
| WO | 2015010345 | A1 | 2/2015 |
| WO | 2016062777 | A1 | 4/2016 |

OTHER PUBLICATIONS

International search report and written opinion, dated Jul. 18, 2016, pp. 1-9.

* cited by examiner

ELECTRONIC SMOKING DEVICE WITH SECONDARY HEATING ELEMENT

FIELD OF INVENTION

The present invention relates generally to electronic smoking devices and in particular electronic cigarettes and to mouthpieces for electronic smoking devices and electronic cigarettes.

BACKGROUND OF THE INVENTION

An electronic smoking device, such as an electronic cigarette (e-cigarette), typically has a housing accommodating an electric power source (e.g. a single use or rechargeable battery, electrical plug, or other power source), and an electrically operable atomizer. The atomizer vaporizes or atomizes liquid supplied from a reservoir and provides vaporized or atomized liquid as an aerosol. Control electronics control the activation of the atomizer. In some electronic cigarettes, an airflow sensor is provided within the electronic smoking device which detects a user puffing on the device (e.g., by sensing an under-pressure or an air flow pattern through the device). The airflow sensor indicates or signals the puff to the control electronics to power up the device and generate vapor. In other e-cigarettes, a switch is used to power up the e-cigarette to generate a puff of vapor.

The convenience of smoking an electronic smoking device is increased when the aerosol consumed mainly contains gaseous components and only few to zero liquid components. It is provided an electronic smoking device and a mouthpiece which allow to ameliorate the vaporization of an aerosol consumable with an electronic smoking device.

SUMMARY OF THE INVENTION

In accordance with one aspect of the present invention there is provided an electronic smoking device which has a mouthpiece at a first end of the electronic smoking device, the mouthpiece having an air inhalation port. The electronic smoking device further comprises an atomizer with a primary heating element and a liquid reservoir. A secondary heating element is provided inside the electronic smoking device at the first end of the electronic smoking device.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

DESCRIPTION OF THE PREFERRED EMBODIMENTS

Figure 1:
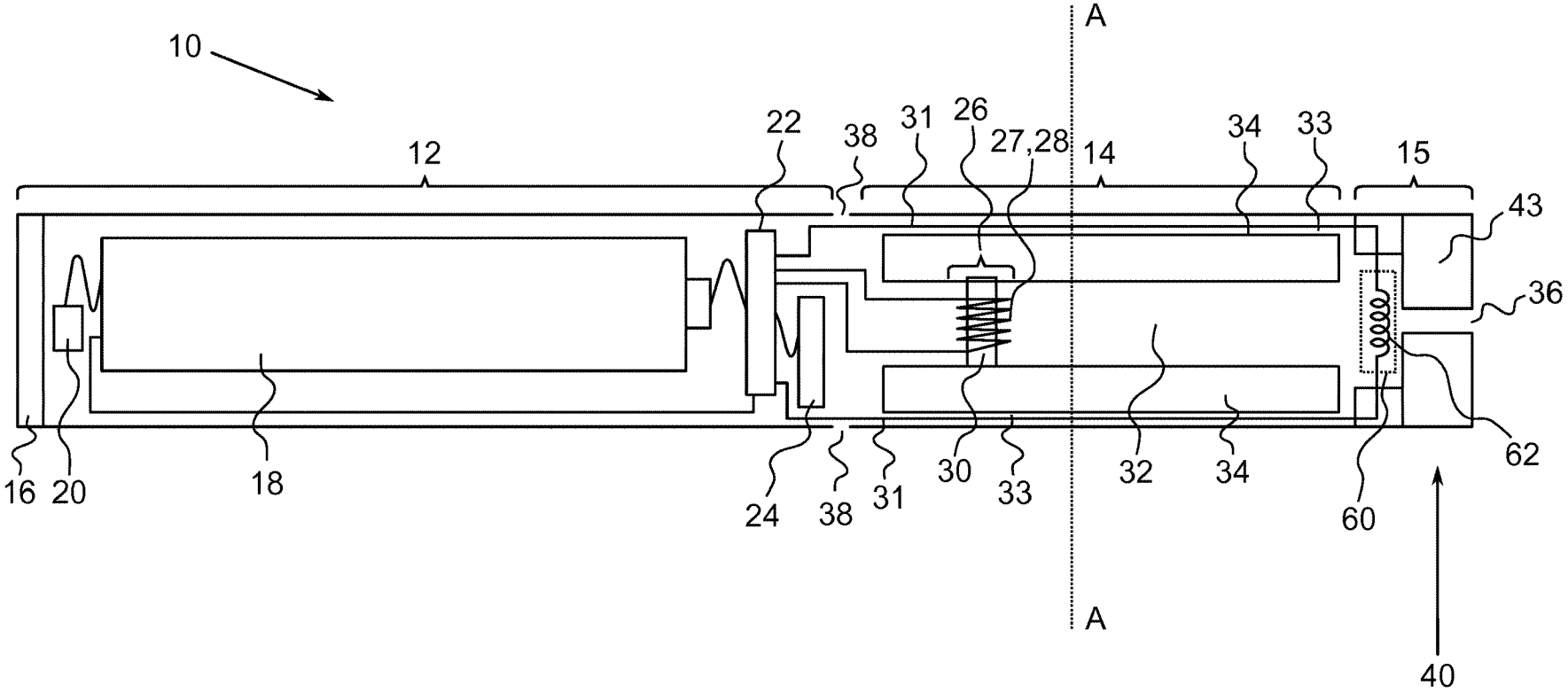
FIG. 1 is a schematic cross-sectional illustration of a first embodiment of an electronic smoking device with a first embodiment of a fixed mouthpiece.

Throughout the following, a first embodiment of an electronic smoking device 10 will be exemplarily described with reference to an e-cigarette. As is shown in FIG. 1, an e-cigarette 10 typically has a housing comprising a cylindrical hollow tube having an end cap 16. The cylindrical hollow tube may be single piece or a multiple piece tube. In FIG. 1, the cylindrical hollow tube is shown as a two piece structure having a battery portion 12 and an atomizer/liquid reservoir portion 14. Together the battery portion 12 and the atomizer/liquid reservoir portion 14 form a cylindrical tube which is approximately the same size and shape as a conventional cigarette, typically about 100 mm with a 7.5 mm diameter, although lengths may range from 70 to 150 or 180 mm, and diameters from 5 to 20 mm.

The battery portion 12 and atomizer/liquid reservoir portion 14 are typically made of steel or hardwearing plastic and act together with the end cap 16 to provide a housing to contain the components of the e-cigarette 10. The battery portion 12 and an atomizer/liquid reservoir portion 14 may be configured to fit together by a friction push fit, a snap fit, or a bayonet attachment, magnetic fit, or screw threads. The end cap 16 is provided at the front end of the battery portion 12. The end cap 16 may be made from translucent plastic or other translucent material to allow an LED 20 positioned near the end cap 16 to emit light through the end cap 16. The end cap 16 can be made of metal or other materials that do not allow light to pass.

An air inlet may be provided in the end cap, at the edge of the inlet next to the cylindrical hollow tube, anywhere along the length of the cylindrical hollow tube, or at the connection of the battery portion 12 and the atomizer/liquid reservoir portion 14. FIG. 1 shows a pair of air inlets 38 provided at the intersection between the battery portion 12 and the atomizer/liquid reservoir portion 14.

A power source 18, in this first embodiment exemplarily realized as a battery, a light emitting diode (LED) 20, control electronics 22 and optionally an airflow sensor 24 are provided within the cylindrical hollow tube battery portion 12. The power source 18 is electrically connected to the control electronics 22, which are electrically connected to the LED 20 and the airflow sensor 24. In this example the LED 20 is at the front end of the battery portion 12, adjacent to the end cap 16 and the control electronics 22 and airflow sensor 24 are provided in the central cavity at the other end of the battery 18 adjacent the atomizer/liquid reservoir portion 14.

The airflow sensor 24 acts as a puff detector, detecting a user puffing or sucking on a mouthpiece 15 which is arranged adjacent to the atomizer/liquid reservoir portion 14 of the e-cigarette 10. The airflow sensor 24 can be any suitable sensor for detecting changes in airflow or air pressure such a microphone switch including a deformable membrane which is caused to move by variations in air pressure. Alternatively the sensor may be a Hall element or an electro-mechanical sensor.

The control electronics 22 are also connected to an atomizer 26. In the example shown, the atomizer 26 includes a primary heating element 27, which in this embodiment is realized as a heating coil 28 which is wrapped around a wick 30 extending across a central passage 32 of the atomizer/liquid reservoir portion 14. The coil 28 may be positioned anywhere in the atomizer 26 and may be transverse or parallel to the liquid reservoir 34. The wick 30 and heating coil 28 do not completely block the central passage 32. Rather an air gap is provided on either side of the heating coil 28 enabling air to flow past the heating coil 28 and the wick 30. The atomizer may alternatively use other forms of primary heating elements 27, such as ceramic heaters, or fiber or mesh material heaters. Nonresistance heating elements such as sonic, piezo and jet spray may also be used in the atomizer in place of the heating coil.

The central passage 32 is surrounded by a cylindrical liquid reservoir 34 with the ends of the wick 30 abutting or extending into the liquid reservoir 34. The wick 30 may be a porous material such as a bundle of fiberglass fibers, with liquid in the liquid reservoir 34 drawn by capillary action from the ends of the wick 30 towards the central portion of the wick 30 encircled by the heating coil 28.

The liquid reservoir 34 may alternatively include wadding soaked in liquid which encircles the central passage 32 with the ends of the wick 30 abutting the wadding. In other embodiments the liquid reservoir 34 may comprise a toroidal cavity arranged to be filled with liquid and with the ends of the wick 30 extending into the toroidal cavity.

An air inhalation port 36 is provided in a mouthpiece 15 at a first end 40 of the electronic smoking device 10 which is fixed to the back end of the atomizer/liquid reservoir portion 14 remote from the end cap 16. The inhalation port 36 may be formed spaced apart from the cylindrical hollow tube atomizer/liquid reservoir portion 14 as a prolongation of the central passage 32 within the cylindrical hollow tube atomizer/liquid reservoir portion 14. A secondary heating element 60, exemplarily realized as a heating wire 62 is provided inside the electronic smoking device 10 at the first end 40 of the electronic smoking device 10. In this embodiment, the secondary heating element 60 is arranged inside the electronic smoking device 10 facing the air inhalation port 36 and is electrically connected to the control electronics 22. Via the control electronics 22, the secondary heating element 60 is electrically connectable to the power source 18. Electrical connectors 31 for electrically connecting the secondary heating element 60 to the power source 18 are provided inside the electronic smoking device 10. Each electrical connector 31 extends from the secondary heating element 60 through a gap formed between the liquid reservoir 34 and a wall of the housing of the electronic smoking device 10 respectively to the control electronics 22. In use, a user sucks on the mouthpiece 15 of the e-cigarette 10. This causes air to be drawn into the e-cigarette 10 via one or more air inlets, such as air inlets 38 and to be drawn through the central passage 32 and through the mouthpiece 15 towards the air inhalation port 36. The change in air pressure which arises is detected by the airflow sensor 24 which generates an electrical signal that is passed to the control electronics 22. In response to the signal, the control electronics 22 activate the primary heating element 27 and the secondary heating element 60. The primary heating element 27 causes liquid present in the wick 30 to be vaporized creating an aerosol (which may comprise gaseous and liquid components) within the central passage 32. As the user continues to suck on the e-cigarette 10, this aerosol is drawn through the central passage 32 up to the secondary heating element 60 where a large amount of remaining liquid droplets contained in the aerosol is further vaporized to gaseous components to be inhaled by the user.

The secondary heating element 60 in the shown embodiment comprises a heating wire 62 but does not comprise a wick since it is not necessary to draw liquid from the liquid reservoir 34 to the secondary heating element 60. Such heating wires 62 are cheap, can simply be heated up and are therefore efficient in vaporizing a liquid and in heating up an aerosol. The aerosol generated by the primary heating element 27 is drawn towards the secondary heating element 60 and remaining droplets in the aerosol are vaporized. Therefore, the vaporization is further improved and the vaping experience becomes more realistic. In addition, the temperature of the aerosol can be maintained at a desired level with the secondary heating element 60 facing the air inhalation port 36.

The mouthpiece 15, just as the battery portion 12 and the atomizer/liquid reservoir portion 14, exemplarily has a cylindrical shape. However, the mouthpiece 15 can also be formed in any other shape. The secondary heating element 60 is arranged within the mouthpiece 15, directly facing the air inhalation port 36. Via the arrangement of the secondary heating element 60 directly adjacent to the air inhalation port 36, aerosol guided to the air inhalation port 36 is forced to pass the secondary heating element 60. The secondary heating element 60 within the mouthpiece 15 is arranged in between the liquid reservoir 34 and the air inhalation port 36. The mouthpiece 15 is arranged closely to the primary heating element 27 and therefore also closely to the center of aerosol generation within the electronic smoking device 10. Aerosol generated by the atomizer 26 follows a short flow path up to the mouthpiece 15 which allows a quick consumption of well tempered aerosol at any time. The liquid reservoir 34 has a central passage 32 for an aerosol flow up to the air inhalation port 36 of the mouthpiece 15, wherein the secondary heating element 60 is arranged in between the central passage 32 of the liquid reservoir 34 and the air inhalation port 36. The central passage 32 extends from the outermost end of the liquid reservoir 34 which is arranged adjacent to the control electronics 22 and the airflow sensor 24 and remote from the mouthpiece 15, up to the air inhalation port 36 of the mouthpiece 15. In use, when a user sucks on the device 10, an aerosol flow extends from the atomizer 26 via the central passage 32 to the air inhalation port 36, passing the secondary heating element 60 arranged in between the air inhalation port 36 and the central passage 32.

In the above described first embodiment, the mouthpiece 15 is irremovably fixed to the other components of the electronic smoking device 10, in more detail, it is fixed to the atomizer/liquid reservoir portion 14 of the electronic smoking device 10. In other embodiments, the mouthpiece 15 may be removable from the atomizer/liquid reservoir portion 14 or fixed to other components of the electronic smoking device 10, for example to the battery portion 12. Furthermore, in this embodiment, the mouthpiece 15 optionally further comprises a nozzle 43 which in this embodiment exemplarily has the shape of a cylinder with a through hole having at its end the air inhalation port 36. The nozzle 43 further improves the air flow to the air inhalation port 36.

It is also possible to realize other embodiments in which the secondary heating element 60 can be activated separately from the primary heating element 27. In operation, the secondary heating element 60 does not need to operate with the same temperature as the primary heating element 27 as it is used to vaporize remaining droplets only. For instance, the secondary heating element 60 may be operated in a first mode when the primary heating element 60 has not reached its optimum temperature and in a second mode when the primary heating element 27 reached its optimum temperature. The first mode may consume more power than the second mode. The secondary heating element 60 may have an elongated shape or the shape of a ring provided facing the air inhalation port 36 and preferably corresponding to the size of the air inhalation port 36.

Figure 3:
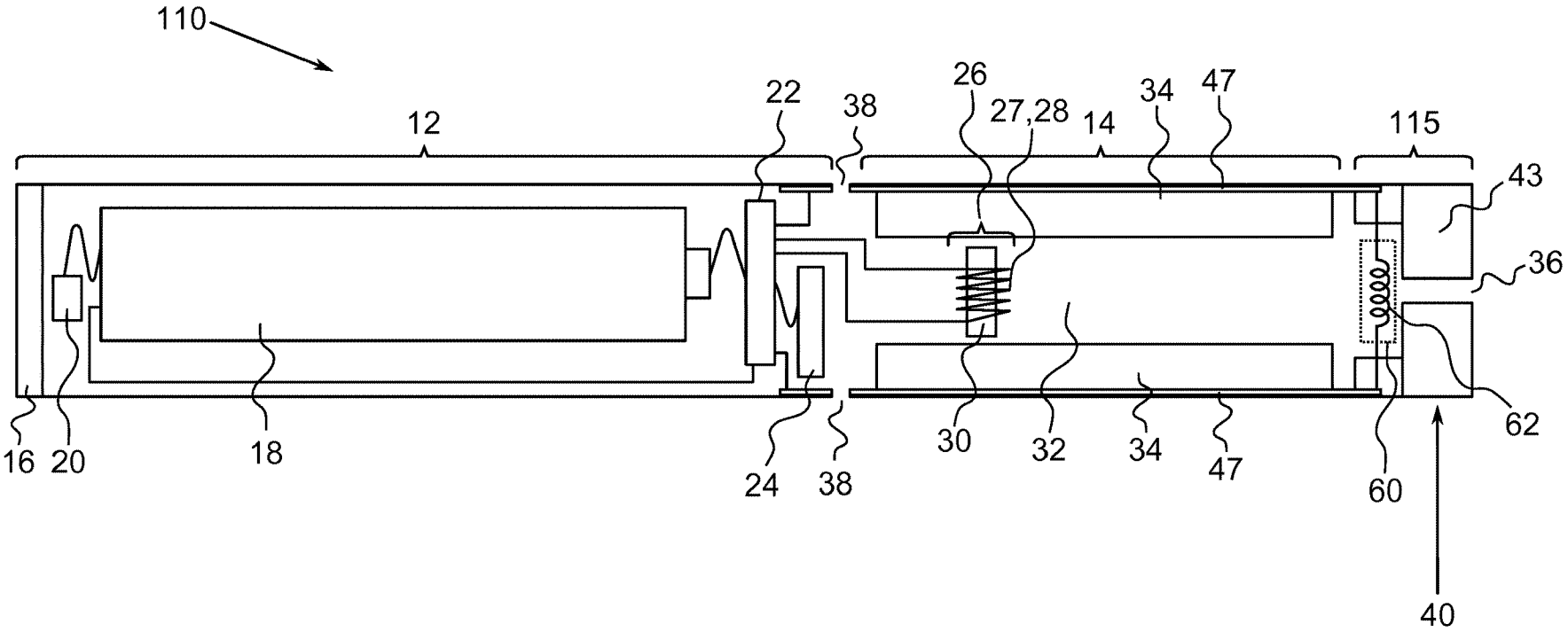
FIG. 3 is a schematic cross-sectional illustration of a second embodiment of an electronic smoking device with a second embodiment of a fixed mouthpiece.
Figure 4:
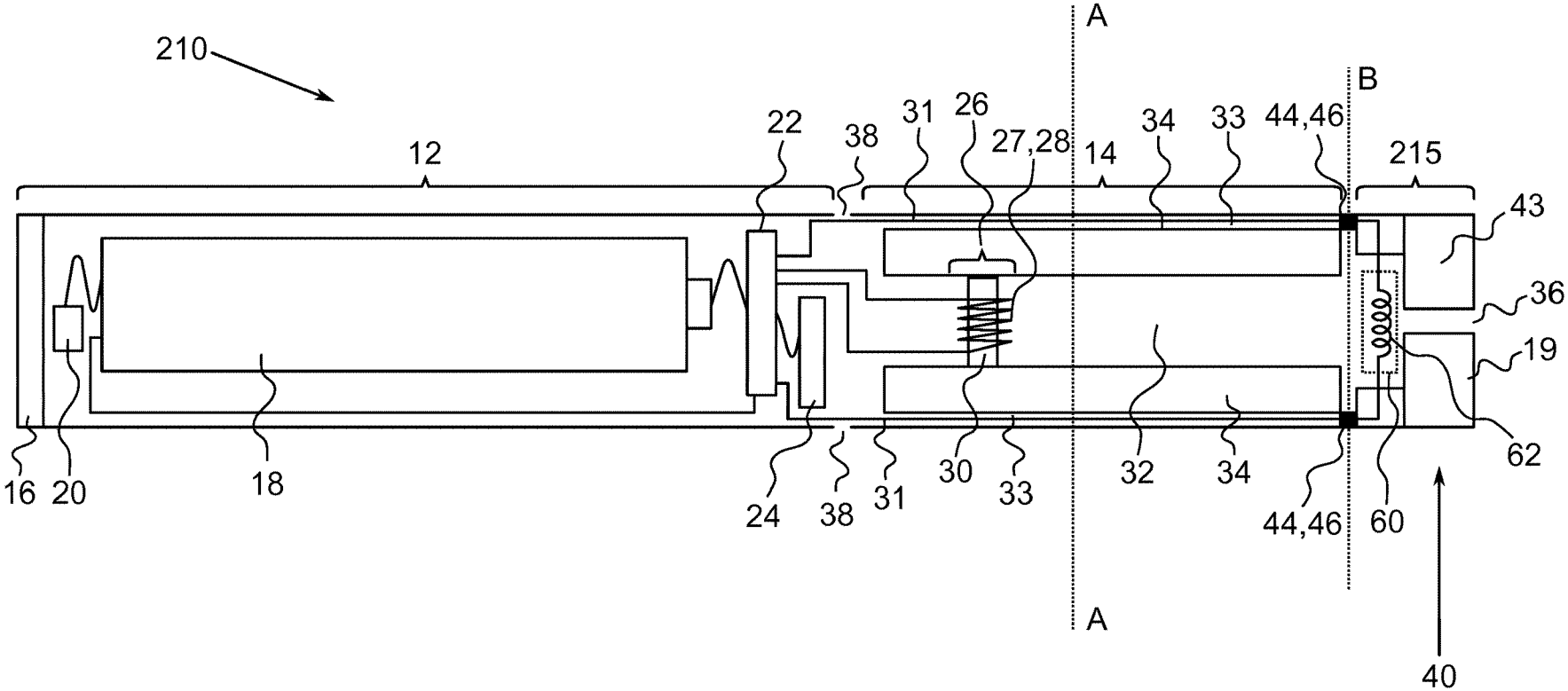
FIG. 4 is a schematic cross-sectional illustration of a third embodiment of an electronic smoking device with a third embodiment of a removable mouthpiece.
Figure 5:
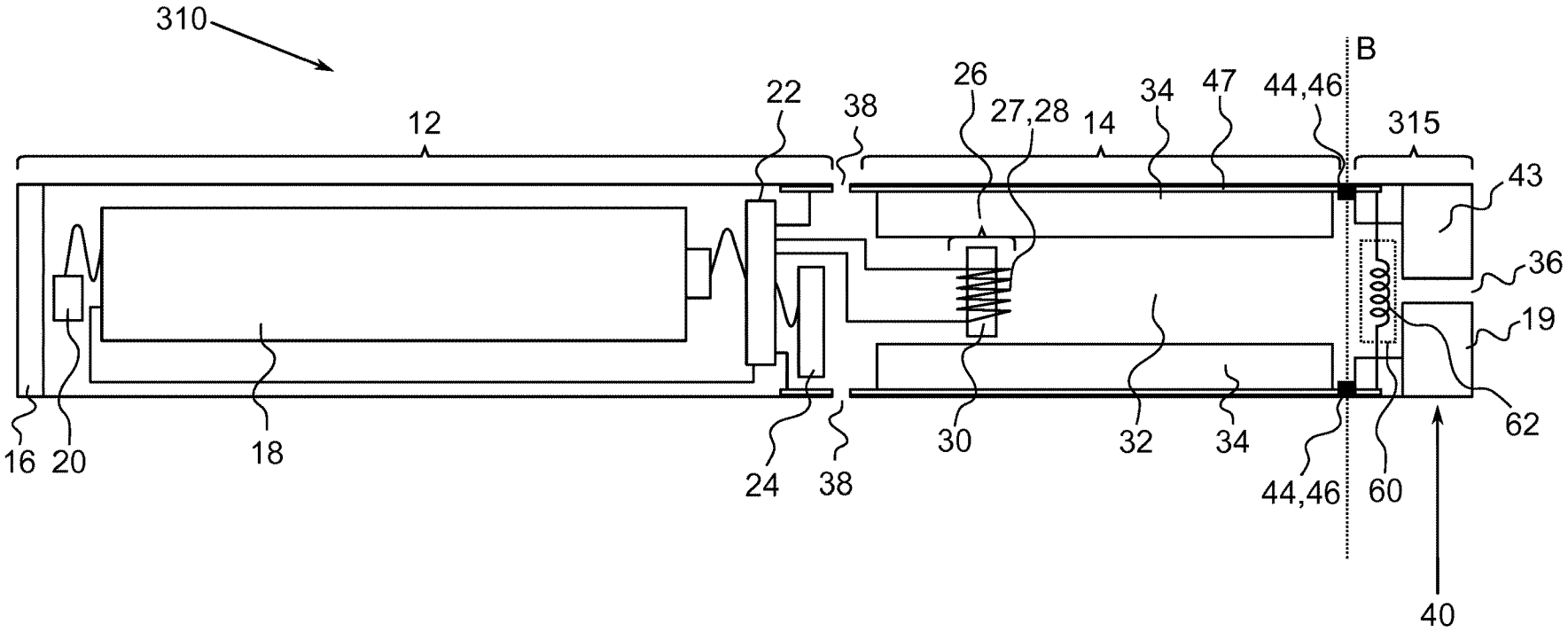
FIG. 5 is a schematic cross-sectional illustration of a fourth embodiment of an electronic smoking device with a fourth embodiment of a removable mouthpiece.

In this first embodiment, continuous cavities 33 are formed within the cylindrical liquid reservoir 34, facing towards the inner surface of the walls of the housing of the electronic smoking device 10. Together with the inner surface of the walls of the housing, the cavities 33 within the liquid reservoir 34 each form a feedthrough extending from the control electronics 22 to the secondary heating element 60 and the mouthpiece 15. The electronic connectors 31 are arranged within these cavities 33 which will be described further hereinafter with respect to FIG. 6 which shows a cross-section of the electronic smoking device 10 as shown in FIGS. 1 and 4 along a plane which in FIGS. 1 and 4 is indicated by a dotted line A. In other embodiments, the electrical connection between a power source 18 of the electronic smoking device 10 and the secondary heating element 60 can be performed differently. In some embodiments, the liquid reservoir 34 does not have cavities 33 and the electrical connectors 31 are arranged differently within the electronic smoking device 10. Furthermore, it is also possible to realize electronic smoking devices 10 with a secondary heating element 60 but without electrical connectors 31 extending along the entire atomizer/liquid reservoir portion 14. Such embodiments are shown in FIGS. 3 and 5.

When the primary heating element 27 is activated, the control electronics 22 also activate the LED 20 causing the LED 20 to light up which is visible via the translucent end cap 16 mimicking the appearance of a glowing ember at the end of a conventional cigarette. As liquid present in the wick 30 is converted into an aerosol more liquid is drawn into the wick 30 from the liquid reservoir 34 by capillary action and thus is available to be converted into an aerosol through subsequent activation of the heating coil 28.

Some e-cigarettes are intended to be disposable and the electric power in the battery 18 is intended to be sufficient to vaporize the liquid contained within the liquid reservoir 34 after which the e-cigarette 10 is thrown away. In other embodiments the power source 18 is rechargeable and the liquid reservoir 34 is refillable. In the cases where the liquid reservoir 34 is a toroidal cavity, this may be achieved by refilling the liquid reservoir 34 via a refill port. In other embodiments the atomizer/liquid reservoir portion 14 of the e-cigarette 10 is detachable from the battery portion 12 and a new atomizer/liquid reservoir portion 14 can be fitted with a new liquid reservoir 34 thereby replenishing the supply of liquid. The atomizer/liquid reservoir portion 14 may be replaced together with the mouthpiece 15 or the mouthpiece 15 may be separately replaceable. In some cases, replacing the liquid reservoir 34 may involve replacement of the heating coil 28 and the wick 30 along with the replacement of the liquid reservoir 34. A replaceable unit comprising the atomizer 26 and the liquid reservoir 34 is called a cartomizer.

The new liquid reservoir 34 may be in the form of a cartridge having a central passage 32 through which a user inhales aerosol. In other embodiments, aerosol may flow around the exterior of the cartridge 32 to an air inhalation port 36.

Of course, in addition to the above description of the structure and function of a typical e-cigarette 10, variations also exist. For example, the LED 20 may be omitted. The airflow sensor 24 may be placed adjacent the end cap 16 rather than in the middle of the e-cigarette. The airflow sensor 24 may be replaced with a switch which enables a user to activate the e-cigarette manually rather than in response to the detection of a change in air flow or air pressure.

Different types of atomizers may be used. Thus for example, the atomizer may have a heating coil in a cavity in the interior of a porous body soaked in liquid. In this design aerosol is generated by evaporating the liquid within the porous body either by activation of the coil heating the porous body or alternatively by the heated air passing over or through the porous body. Alternatively the atomizer may use a piezoelectric atomizer to create an aerosol either in combination or in the absence of a heater.

Figure 2:
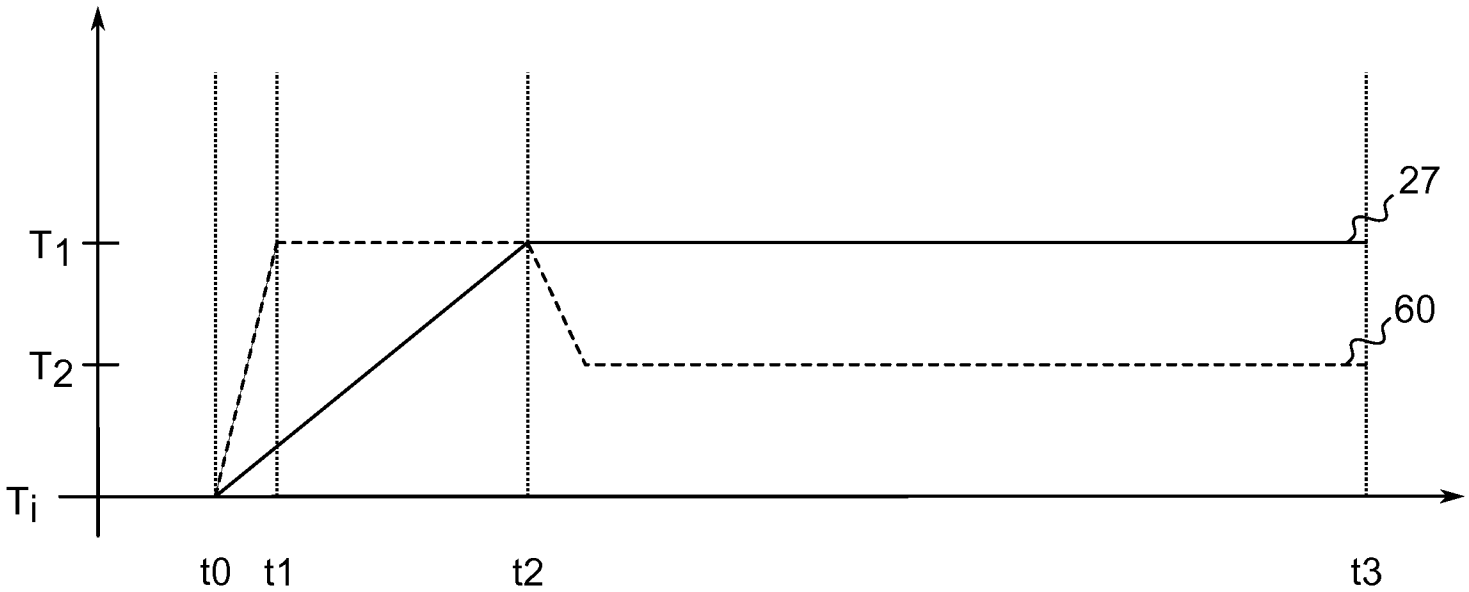
FIG. 2 is a diagram showing a possible mode of operation of the primary and secondary heating elements of the first embodiment of an electronic smoking device.

In FIG. 2, a diagram indicating a possible mode of operation of the primary and secondary heating elements 27, 60 of the first embodiment of the electronic smoking device 10 is shown. In more detail, the diagram shows the temperature of the primary and secondary heating elements 27, 60 over time, wherein the ordinate of the diagram indicates the temperature and wherein the abscissa of the diagram represents a time bar. The continuous graph of the diagram indicates the temperature of the primary heating element throughout a time period $t_0$ to $t_3$, wherein the dotted graph of the diagram indicates the temperature of the secondary heating element throughout the same time period. When a puff is detected in $t_0$, the primary and secondary heating elements 27, 60 are both operated.

As long as the electronic smoking device 10 is in use, a constant amount of energy is supplied to the primary heating element 60. Within a heating-up phase during a ramp-up time period t0 to t2, the temperature of the primary heating element 27 rises from an initial temperature Ti to a predefined first mode operation temperature T1 which is equal to the destined operation temperature of the primary heating element 27. Since the amount of energy supplied to the primary heating element 27 is not altered during operation, the temperature of the primary heating element 27 remains constantly equal to the first mode operation temperature T1 after this temperature is reached at the time t2. Therefore, during the time period t2 to t3, the temperature of the primary heating element 27 is equal to $T_1$. During the heating-up phase ($t_0$ to $t_2$) of the primary heating element 27, the aerosol generated by the atomizer 26 has an excess of undesired liquid components since the thermal energy provided by the primary heating element 27 is not sufficient to fully vaporize the liquid leaving the wick 30. Therefore, the secondary heating element 60 is operated in a first mode of operation during the heating-up phase ($t_0$ to $t_2$) of the primary heating element 27. In this first mode of operation, a predefined amount of energy is supplied to the secondary heating element 60 which causes it to gain the predefined first mode operation temperature $T_1$ in a time period $t_0$ to $t_1$ which is shorter than the ramp-up time period $t_0$ to $t_2$ of the primary heating element 27. As long as the primary heating element 27 has not reached the temperature $T_1$, the secondary heating element 60 is operated in the first mode, maintaining the predefined first mode operation temperature $T_1$. In this first mode of operation, the secondary heating element 60 substantially decreases the excess ratio of liquid components given within the aerosol generated by the atomizer 26 during the heating-up phase (t0 to t2) of the primary heating element 27.

When the primary heating element 27 has reached the predefined first mode operation temperature $T_1$, the amount of liquid components within the aerosol generated by the atomizer 26 is reduced, compared to the amount given during the ramp-up time period $t_0$ to $t_2$. This is due to the higher thermal energy provided by the primary heating element 27 at the higher temperature $T_1$. When the temperature of the primary heating element 27 has reached $T_1$, the amount of energy supplied to the secondary heating element 60 can be reduced. Therefore, from the time $t_2$ on, the secondary heating element 60 is operated in a second mode of operation which causes the temperature of the secondary heating element 60 to drop to a predefined second mode operation temperature $T_2$. The predefined second mode operation temperature $T_2$ is smaller than the predefined first mode operation temperature $T_1$. Until the electronic smoking device 10 is switched off in $t_3$, the primary heating element 27 maintains the predefined first mode operation temperature $T_1$ and the secondary heating element 60 maintains the predefined second mode operation temperature $T_2$.

However, this mode of operation of the primary and secondary heating elements 27, 60 is only exemplary and other modes of operation of the two heating elements 27, 60 are possible. Especially, it is possible to realize embodiments of electronic smoking devices 10 with primary and secondary heating elements 27, 60 which are independently operable and/or which can be separately or simultaneously activated by a user according to his own preferences.

In FIG. 3 a schematic cross-sectional illustration of a second embodiment of an electronic smoking device 110 with a second embodiment of a fixed mouthpiece 115 is shown. The electronic smoking device 110 as shown in FIG. 3 is substantially identical to the electronic smoking device 10 as shown in FIG. 1. Therefore, the components of the second embodiment with reference signs which are identical to the reference signs shown in FIG. 1 are identical to these respective components of the first embodiment.

The second embodiment as shown in FIG. 3 differs from the first embodiment in that the electronic smoking device 110 has no electrical connectors 31 and no cavities 33 formed within the liquid reservoir 34. Instead, the electrical connection of the secondary heating element 60 is provided via the housing of the electronic smoking device 110 which comprises conductive elements 47. In this second embodiment, these conductive elements 47 are metal plates which are attached to a fraction of the inner surface of the housing of the electronic smoking device 110. In more detail, metal plates or metal strips are attached to a fraction of the inner surface of the housing inside the electronic smoking device 110. In other embodiments, the surface or a fraction of the surface of the inner walls of the housing of the electronic smoking device 110 is coated or otherwise covered with a conductive material. In further embodiments, conductive elements 47 as electrical connectors are embedded or integrated in the inner walls of the housing of the electronic smoking device 110. The conductive elements 47 extend from the control electronics 22 to the secondary heating element 60 and electrically connect the secondary heating element 60 to the control electronics 22/the power source 18. In more detail, the terminals of the secondary heating element 60 are electrically connected—in this second embodiment exemplarily soldered—to the conductive elements 47. Furthermore, the corresponding electrical terminals or the respective pins of the control electronics 22 are also electrically connected to the conductive elements 47. Therefore, the control electronics 22 and the secondary heating element 60 are electrically connected to each other.

In FIG. 4, a schematic cross-sectional illustration of a third embodiment of an electronic smoking device 210 with a removable mouthpiece 215 is shown. The third embodiment is substantially identical to the first embodiment of the electronic smoking device 10 as shown in FIG. 1 and as described hereinbefore. Therefore, the components of the third embodiment with reference signs which are identical to the reference signs shown in FIG. 1 are identical to these respective components of the first embodiment. The third embodiment as shown in FIG. 4 differs from the first embodiment in that the mouthpiece 215 has a body 19 which is configured removable. In more detail, in FIG. 4, the mouthpiece 215 is removeably fixed to the atomizer/liquid reservoir portion 14.

In this third embodiment, the secondary heating element 60 is arranged within the removable mouthpiece 215, directly facing the air inhalation port 36. In such an embodiment, the secondary heating element 60 can be removed and exchanged together with the mouthpiece 215 as a single component. Upon fixation, the mouthpiece 215 is arranged adjacent to the liquid reservoir 34. In this state, the secondary heating element 60 within the mouthpiece 215 is arranged in between the liquid reservoir 34 and the air inhalation port 36. The mouthpiece 215 can be detachably fixed to the liquid reservoir 34 or the atomizer/liquid reservoir portion 14 of the device 210. In this third embodiment, the mouthpiece 215, together with the secondary heating element 60 therein, can be removed from the atomizer/liquid reservoir portion 14 and the liquid reservoir 34 along a plane which in FIG. 4 is indicated by a dotted line B.

In this third embodiment, the secondary heating element 60 is connected to the power source 18 of the electronic smoking device 210 via primary and secondary electrical contact elements 44, 46 when the mouthpiece 215 is fixed to the liquid reservoir 34. The primary and secondary electrical contact elements 44, 46 will be described further hereinafter with respect to the FIGS. 7 to 11. In order to supply power from the power source 18 of the electronic smoking device 210 to the first end 40 of the electronic smoking device 210 and the secondary heating element 60 of the mouthpiece 215, electrical connectors 31 are provided within the electronic smoking device 210, extending from the control electronics 22 to the secondary electrical contact elements 46 which are arranged adjacent to the mouthpiece 215 and to the liquid reservoir 34. In this third embodiment, continuous cavities 33 are formed within the cylindrical liquid reservoir 34, facing towards the inner surface of the walls of the housing of the electronic smoking device 210. Together with the inner surface of the walls of the housing, the cavities 33 within the liquid reservoir 34 each form a feedthrough extending from the control electronics 22 to the secondary electrical contact elements 46. The electronic connectors 31 are arranged within these cavities 33 which will be described further hereinafter with respect to FIG. 6 which shows a cross-section of the electronic smoking devices 10, 210 as shown in FIGS. 1 and 4 along a plane which in FIG. 4 is indicated by a dotted line A. In other embodiments, the electrical connection between a power source 18 of the electronic smoking device 210 and the secondary heating element 60 can be performed differently. In some embodiments, the liquid reservoir 34 does not have cavities 33 and the electrical connectors 31 are arranged differently within the electronic smoking device 10. Furthermore, it is also possible to realize electronic smoking devices 10 with a secondary heating element 60 but without electrical connectors 31. In such an embodiment, an electrical connection between the control electronics 22/the power source 18 of the electronic smoking device 10 and the secondary heating element 60 can for example be performed via conductive elements 47 of the housing of the electronic smoking device 210. Such an embodiment is shown in FIG. 5.

FIG. 5 shows a schematic cross-sectional illustration of a fourth embodiment of an electronic smoking device 310 with a fourth embodiment of a removable mouthpiece 315. The fourth embodiment is substantially identical to the third embodiment of the electronic smoking device 210 as shown in FIG. 4 and as described hereinbefore. Therefore, the components of the fourth embodiment with reference signs which are identical to the reference signs shown in FIG. 4 are identical to these respective components of the third embodiment.

The fourth embodiment as shown in FIG. 5 differs from the third embodiment in that the electronic smoking device 310 has no electrical connectors 31 and no cavities 33 formed within the cylindrical liquid reservoir 34. Instead, the electrical connection of the secondary heating element 60 is provided via the housing of the electronic smoking device 310 which comprises conductive elements 47. In this fourth embodiment, the conductive elements 47 are metal plates which are attached to a fraction of the inner surface of the housing of the electronic smoking device 310. In more detail, metal plates or metal strips are attached to a fraction of the inner surface of the housing inside the electronic smoking device 310. In other embodiments, the surface or a fraction of the surface of the inner walls of the housing of the electronic smoking device 310 is coated or otherwise covered with a conductive material. In further embodiments, conductive elements 47 as electrical connectors are embedded or integrated in the inner walls of the housing of the electronic smoking device 110. Also in this fourth embodiment, the secondary heating element 60 is connected to the power source 18 of the electronic smoking device 210 via primary and secondary electrical contact elements 44, 46 when the mouthpiece 315 is fixed to the liquid reservoir 34. The secondary electrical contact elements 46, which will be described further hereinafter, are electrically connected and fixed to the conductive elements 47 of the housing. In more detail, the conductive elements 47 extend from the control electronics 22 to the secondary electrical contact elements 46 and electrically connect the secondary electrical contact elements 46 to the control electronics 22/the power source 18, wherein the secondary electrical contact elements 46 are soldered to the conductive elements 47. Furthermore, the corresponding electrical terminals or the respective pins of the control electronics 22 are also electrically connected to the conductive elements 47. Therefore, the control electronics 22 and the secondary heating element 60 are electrically connected to each other via the conductive elements 47 when the mouthpiece 315 is fixed to the liquid reservoir 34 of the electronic smoking device 310.

Figure 6:
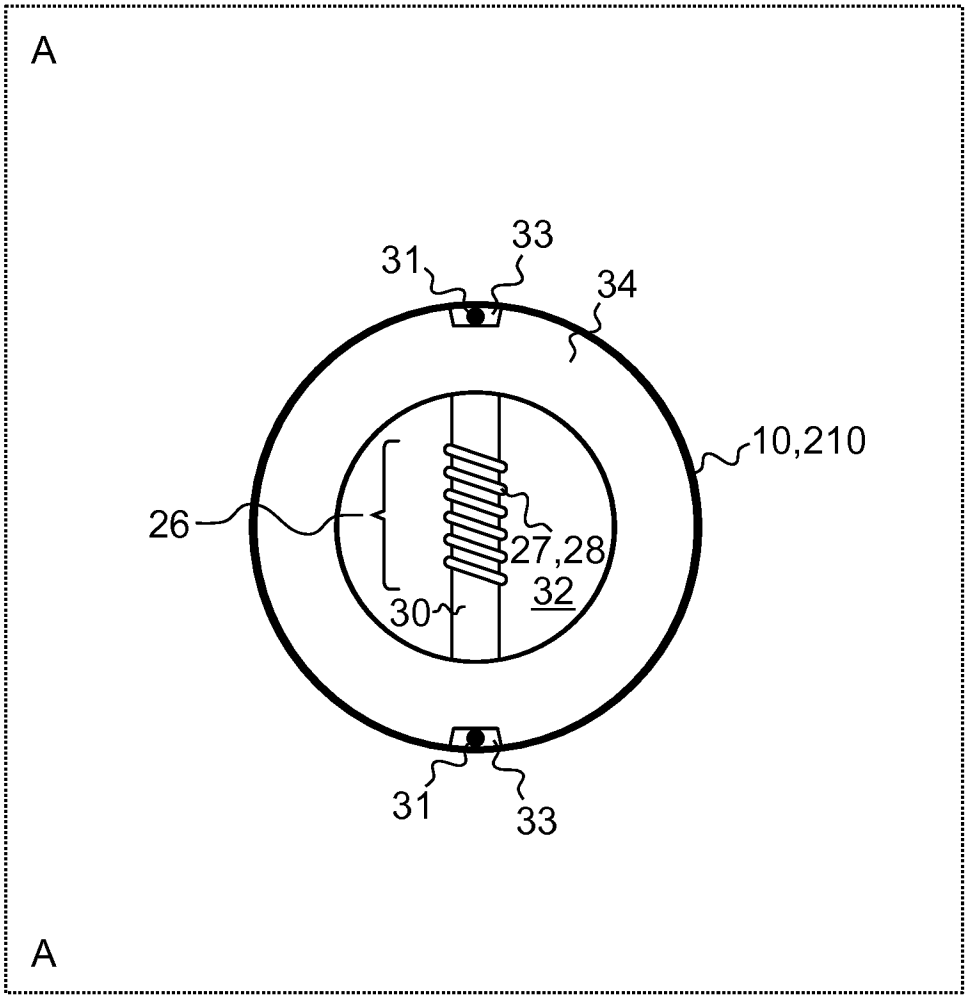
FIG. 6 is a schematic cross-sectional illustration of the first and third embodiment of an electronic smoking device.

FIG. 6 shows a schematic cross-sectional illustration of the first and third embodiment of an electronic smoking device 10, 210. In other words, FIG. 6 shows a cross-section through the first and third embodiment of an electronic smoking device 10, 210 as shown in FIGS. 1 and 4 and as described hereinbefore. The cross-section along the dotted line A (see FIGS. 1 and 4) shows an insight into the liquid reservoir 34, including the cavities 33 with the electrical connectors 31 therein and the atomizer 26 with the wick 30 and the primary heating element 27 which is realized as a heating coil 28. In this first and third embodiment, the cavities 33, together with the housing of the electronic smoking device 10, 210 each form a substantially trapezoidal feedthrough. However, other cavities 33 with another position within the liquid reservoir 34 and another shape can be realized. Furthermore, a cavity 33 does not necessarily have to face an inner surface of the housing of the electronic smoking device 10, 210 but can also be fully enclosed by the walls of the liquid reservoir 34.

In the first and third embodiment, the wick 30 extends across the central passage 32 of the liquid reservoir portion 14 and into the liquid reservoir 34 at diametrically opposite points of the same. The heating coil 28 of the primary heating element 27 is wrapped around the wick 30.

Figure 7:
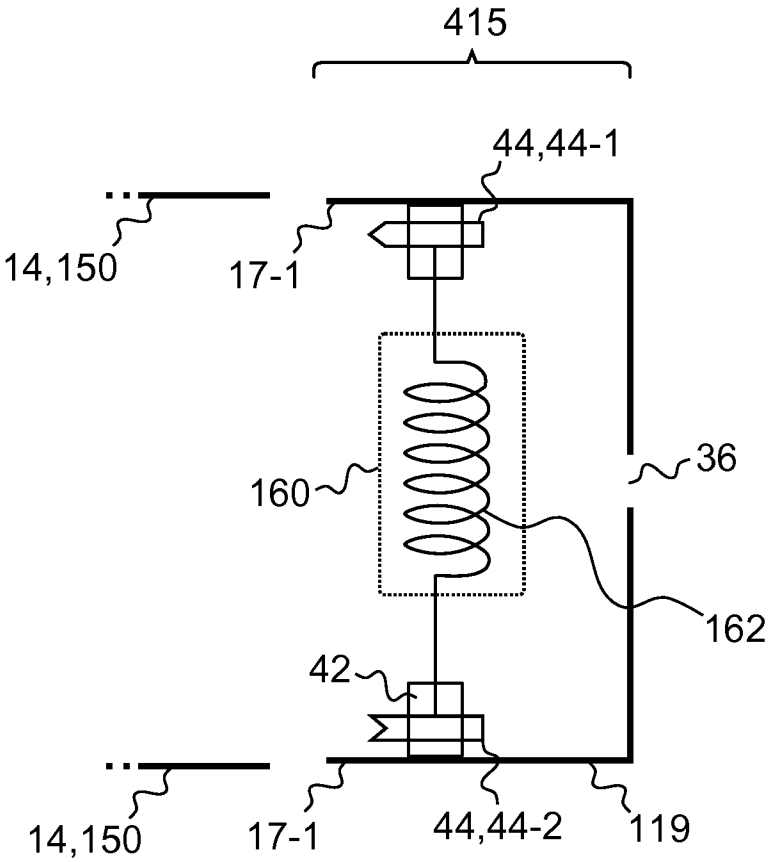
FIG. 7 is a schematic cross-sectional illustration of a fifth embodiment of a mouthpiece for an electronic smoking device.

In FIG. 7, a schematic cross-sectional illustration of a fifth embodiment of a mouthpiece 415 for an electronic smoking device is shown. The mouthpiece 415 comprises a body 119 with an air inhalation port 36 therein and a secondary heating element 160 which is arranged within the body 119 and exemplarily realized as a heating wire 162. In such an embodiment, the mouthpiece 415 with the secondary heating element 160 therein can be separately exchanged. This allows a user to use different types of mouthpieces 415 with one and the same electronic smoking device. However, the invention is not restricted to heating wires 162 used as secondary heating elements 160 and it is also possible to realize electronic smoking devices with mouthpieces 415 that have different secondary heating elements 160 as described hereinbefore. The mouthpiece 415 does not comprise a liquid reservoir or a wick. Therefore, the mouthpiece 415 can easily be fabricated and is cost-efficient. In this second embodiment, the body 119 of the mouthpiece 415 has a substantially cylindrical shape. However, it is also possible to realize electronic smoking devices with mouthpieces 415 that have different shapes which are not cylindrical. The mouthpiece 415 further comprises a primary elastic element 42 extending along the inner circumference of the body 119 of the mouthpiece 415. The primary elastic element 42 in this embodiment is realized as an elastic ring which exemplarily comprises silicone and which extends along the inner circumference of the body 119, covering a fraction of the inner surface of the body 119. However, it is also possible to realize mouthpieces 415 with other primary elastic elements 42 comprising other elastic materials, such as for example half-ring-shaped elastic elements which do not or only in part extend along the circumference of the body 119 of the mouthpiece 415 and which comprise different kinds of rubber. Such a primary elastic element 42 can serve as a fixation means for further components of the electronic smoking device. Furthermore, such elastic elements 42 may seal the mouthpiece 415 upon fixation of the same to the housing of the electronic smoking device, so that dirt from outside the electronic smoking device is prevented from entering the electronic smoking device and the mouthpiece 415.

In this embodiment, the mouthpiece 415 comprises primary contact elements 44. The secondary heating element 160 within the mouthpiece 415 is electrically connected to these primary contact elements 44 which are adapted to electrically connect the secondary heating element 160 to a power source of the electronic smoking device upon fixation of the mouthpiece 415. In such an embodiment, the secondary heating element 160 is connected to a power source as soon as the mouthpiece 415 is connected to a respective connection portion of the electronic smoking device, for example to the connection portion of a liquid reservoir of an electronic smoking device. Such primary electrical contact elements 44 furthermore increase the safety of the device, since the secondary heating element 160 cannot be powered when the mouthpiece 415 is removed from the other components of the electronic smoking device. In this embodiment, the primary contact elements 44 comprise two primary contact pins 44-1, 44-2. However, it is also possible to realize primary contact elements 44 with more than two primary contact pins 44-1, 44-2 or with other contact elements 44 that allow to electrically connect the secondary heating element 60 and the power source of an electronic smoking device. Such contact pins 44-1, 44-2 allow an easy but nevertheless safe electrical interconnection of the secondary heating element 160 and the power source of an electronic smoking device.

The first of the two primary contact pins 44-1 comprises a male connection part with a peak wherein the second of the two primary contact pins 44-2 comprises a female connection part with a cavity. Secondary electrical contact elements corresponding to the first and second primary contact pins 44-1, 44-2 are arranged within the electronic smoking device (not shown). In this second embodiment of the mouthpiece 415, the primary electrical contact elements 44 are arranged within the primary elastic element 42. In other words, the primary electrical contact elements 44 are held by the primary elastic element 42, which in this embodiment exemplarily is realized as an elastic ring. The two primary contact pins 44-1, 44-2 are arranged on opposing sides of the ring. However, it is also possible to arrange the two primary contact pins 44-1, 44-2 at other positions of the primary elastic element 42. Furthermore, the primary elastic elements 42 may be substituted by primary fixation means which are not elastic but have the same shape and just serve the purpose of providing a fixation element, preferably formed from a solid material, for the primary electrical contact elements 44.

The mouthpiece 415 comprises a member of a press-fit connection 17-1, wherein the diameter of the body 119 of the mouthpiece 415 corresponds to the diameter of the liquid reservoir portion 14 of the electronic smoking device. In FIG. 7, only a connection portion 150 of the liquid reservoir portion 14 is shown which has a slightly greater diameter than the body 119 of the mouthpiece 415. Therefore, the body 119 of the mouthpiece 415 can be press-fitted into the corresponding connection portion 150 of the liquid reservoir portion 14. In other embodiments, the mouthpiece 415 may additionally comprise a nozzle or any other component which serves to prevent a user from contacting the secondary heating element 160 through the air inhalation port 36 with his or her tongue by narrowing the air inhalation port 36. Press-fit connections are simple connections which allow a quick and easy connection of two or more components.

Figure 8:
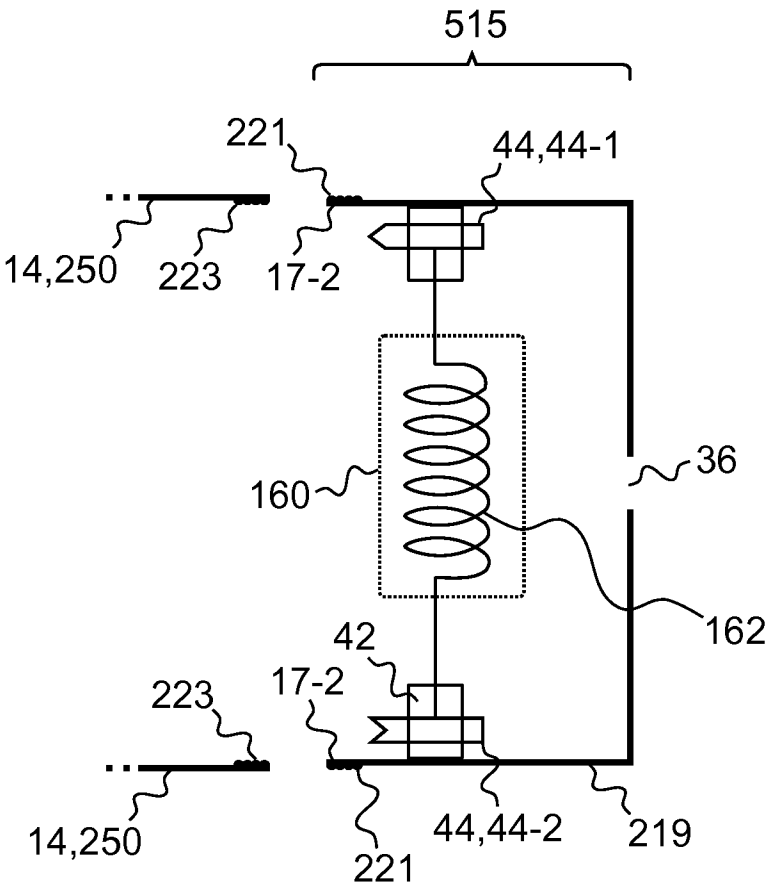
FIG. 8 is a schematic cross-sectional illustration of a sixth embodiment of a mouthpiece for an electronic smoking device.

In FIG. 8, a schematic cross-sectional illustration of a sixth embodiment of a mouthpiece 515 for an electronic smoking device is shown. This sixth embodiment of a mouthpiece 515 is substantially identical to the fifth embodiment of the mouthpiece 415 as shown in FIG. 7 and as described hereinbefore. In this sixth embodiment, the mouthpiece 515 also comprises a primary elastic element 42 with primary electrical contact elements 44 held therein and a secondary heating element 160 realized as a heating wire 162 which have the same features and function as the primary elastic element 42, the primary electrical contact elements 44 and the secondary heating element 160/heating wire 162 as described hereinbefore respectively. The body 219 of this sixth embodiment of a mouthpiece 515 also comprises an air inhalation port 36 which exemplarily is arranged in the center of the outermost end of the body 219 of the mouthpiece 515.

The mouthpiece 515 as shown in FIG. 8 differs from the mouthpiece 415 as shown in FIG. 7 only in that its body 219 comprises a member of a screw-fit connection 17-2 instead of a member of a press-fit connection. In more detail, in this sixth embodiment, the body 219 of the mouthpiece 515 exemplarily comprises an external thread 221 as a member of a screw-fit connection 17-2. This external thread 221 corresponds to an internal thread 223 which is arranged on a connection portion 250 of a liquid reservoir portion 14 of an electronic smoking device. In FIG. 8, besides the mouthpiece 515, also this connection portion 250 of the liquid reservoir portion 14 of the electronic smoking device is shown. A user can fix the mouthpiece 515 to the reservoir portion 14 of the electronic smoking device by screwing it to the connection portion 250 of the electronic smoking device. However, it is also possible to realize electronic smoking devices with a mouthpiece 515 which can be screw-fitted to other components of the electronic smoking device and not to the liquid reservoir portion 14. Furthermore, also the body 219 of the mouthpiece 515 can comprise an internal thread 223 which corresponds to an external thread 221 which is comprised by any connection portion 250 of an electronic smoking device. Screw-fit connections are stable connections which serve to tightly fix two components to one another.

Figure 9:
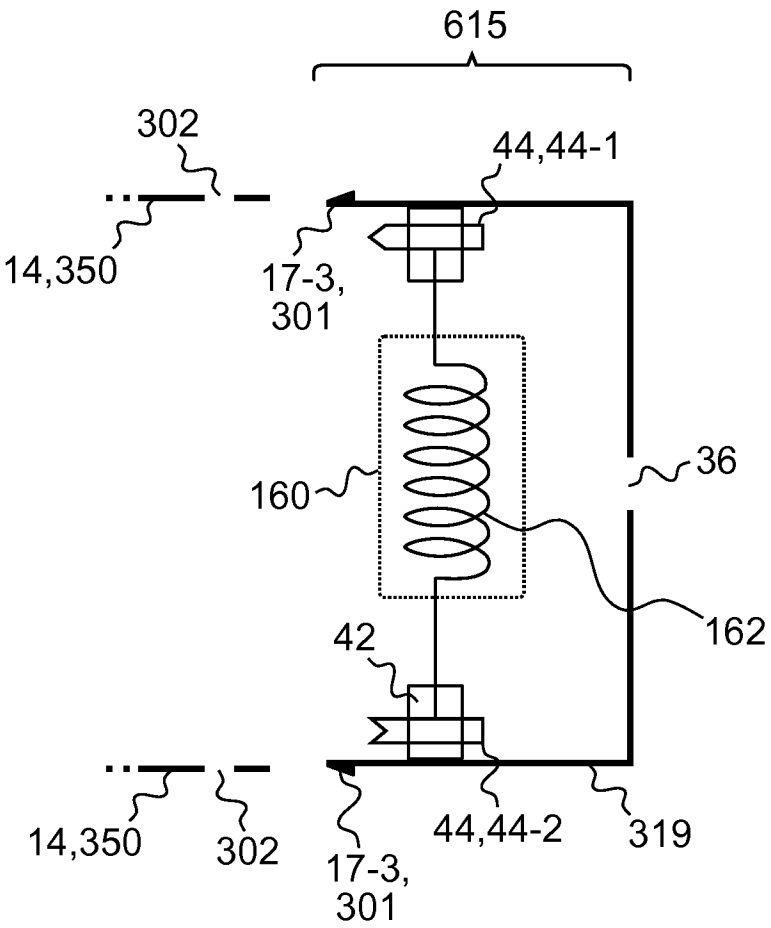
FIG. 9 is a schematic cross-sectional illustration of a seventh embodiment of a mouthpiece for an electronic smoking device.

In FIG. 9, a schematic cross-sectional illustration of a seventh embodiment of a mouthpiece 615 for an electronic smoking device is shown. This seventh embodiment of a mouthpiece 615 is substantially identical to the embodiments of the mouthpieces 415, 515 as shown in FIGS. 7 and 8 and as described hereinbefore. In this seventh embodiment, the mouthpiece 615 also comprises a primary elastic element 42 with primary electrical contact elements 44 held therein and a secondary heating element 160 realized as a heating wire 162 which have the same features and function as the primary elastic element 42, the primary electrical contact elements 44 and the secondary heating element 160/heating wire 162 as described hereinbefore respectively. The body 319 of this seventh embodiment of a mouthpiece 615 also comprises an air inhalation port 36 which is arranged in the center of the outermost end of the body 319 of the mouthpiece 36. However, the arrangement of the air inhalation port 36 within the mouthpiece 615 can also differ from the one shown in FIG. 9.

The mouthpiece 615 as shown in FIG. 9 differs from the mouthpieces 415, 515 as shown in FIGS. 7 and 8 in that the body 319 comprises a snap-action connection 17-3 instead of a press-fit or a screw-fit connection. The body 319 of the mouthpiece 615 comprises two retaining lugs 301 which are arranged on external surfaces of the body 319 remote from the air inhalation port 36. However, it is also possible to realize mouthpieces 615 with snap-action connections 17-3 with only one or more than two retaining lugs 301. The retaining lugs 301 correspond to two fixation holes 302 which are arranged within the connection portion 350 of a liquid reservoir portion 14 of an electronic smoking device. When the body 319 of the mouthpiece 615 is pushed inside the connection portion 350 of the liquid reservoir portion 14, the retaining lugs 301 of the snap-action connections 17-3 snap into the corresponding fixation holes 302 of the connection portion 350 of the liquid reservoir portion 14, thereby fixing the mouthpiece 615 to the liquid reservoir portion 14 of the electronic smoking device. However, it is also possible to realize electronic smoking devices with mouthpieces 615 which can be fixed to other components of the electronic smoking device and not to the liquid reservoir portion 14 of the same. Snap-action connections allow a safe and easily detachable connection between two or more than two components. In further embodiments, mouthpieces and the connection portions of electronic smoking devices may be configured to fit together by a bayonet attachment or a magnetic fit.

Figure 10:
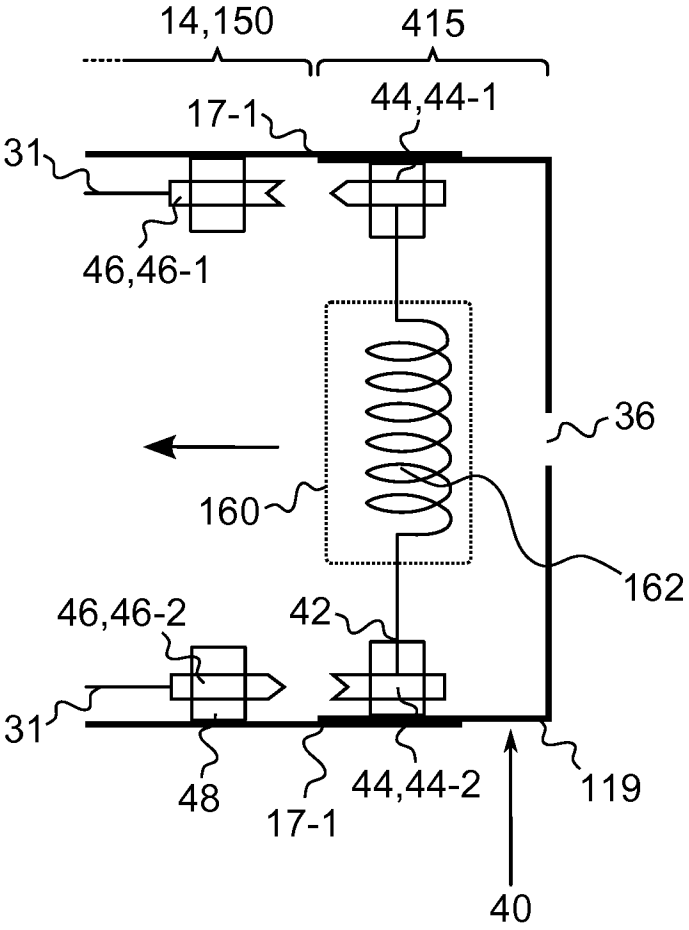
FIG. 10 is a schematic cross-sectional illustration of the fifth embodiment of a mouthpiece which is mounted to the connection portion of a liquid reservoir portion of an electronic smoking device.

In FIG. 10, a schematic cross-sectional illustration of the fifth embodiment of a mouthpiece 415 that is mounted to the connection portion 150 of a liquid reservoir portion 14 of an electronic smoking device is shown. In other words, FIG. 10 shows the fifth embodiment of the mouthpiece 415 as shown in FIG. 7 which is press-fitted to the connection portion 150 of a liquid reservoir portion 14 of an electronic smoking device. The mouthpiece 415 is pushed into the connection portion 150, along a direction which in FIG. 10 is indicated by an arrow. In this embodiment, the electronic smoking device further comprises secondary electrical contact elements 46 which are electrically connected to the power source of the electronic smoking device and adapted to receive the primary electrical contact elements 44. Such secondary electrical contact elements 46 allow an easy and stable electrical connection between the secondary heating element 160 and the power source of the electronic smoking device upon fixation of the mouthpiece 415 to the connection portion 150 of the liquid reservoir portion 14 of the electronic smoking device. In this embodiment, the secondary electrical contact elements 46 exemplarily comprise two secondary contact pins 46-1, 46-2 which have the same shape and size as the primary contact pins 44-1, 44-2 of the primary electrical contact elements 44 of the mouthpiece 415. However, compared to the arrangement of the primary contact pins 44-1, 44-2, the arrangement of the two secondary contact pins 46-1, 46-2 is switched, so that a male part of a secondary contact pin 46-1, 46-2 corresponds to a female part of a primary contact pin 44-1, 44-2 and vice versa. In other embodiments, other secondary electrical contact elements 46 can be used in order to provide an electrical contact between the primary electrical contact elements 44 and the power source of an electronic smoking device. Each secondary contact pin 46-1, 46-2 is electrically connected to one of the electrical connectors 31 or conductive element 47 of the electronic smoking device respectively (also see FIGS. 4 and 5).

Moreover, in this embodiment, the electronic smoking device further comprises a secondary elastic element 48 which extends along an inner circumference of the housing of the electronic smoking device, wherein the secondary electrical contact elements 46 are arranged within the secondary elastic element 48. In other words, the secondary electrical contact elements 46 are held by the secondary elastic element 48. In such an embodiment, the electronic smoking device is further sealed against an entrance of dirt into the device and the electrical contacting of the primary electrical contact elements 44 can easily be performed. In this embodiment, the secondary elastic element 48 exemplarily has the same size and shape as the primary elastic element 42 and extends along an inner circumference of the housing of the electronic smoking device. In other words, the secondary elastic element 48 has the shape of a ring that extends along an inner surface of the housing. The secondary contact pins 46-1, 46-2 are arranged at diametrically opposite points of the ring. However, also other embodiments of electronic smoking devices with other secondary elastic elements 48 can be realized, for example with secondary elastic elements 48 which only extend along a part of the inner circumference of the housing of the electronic smoking device.

When the mouthpiece 415 is fully inserted into the connection portion 150 of the liquid reservoir portion 14, the mouthpiece 415 is fixed within the same via its press-fit connection 17-1 and the primary contact pins 44-1, 44-2 are physically and electrically connected to the secondary contact pins 46-1, 46-2. In such a state, the secondary heating element 160—in other words the heating wire 162—is electrically connected to the power source of the electronic smoking device.

Figure 11:
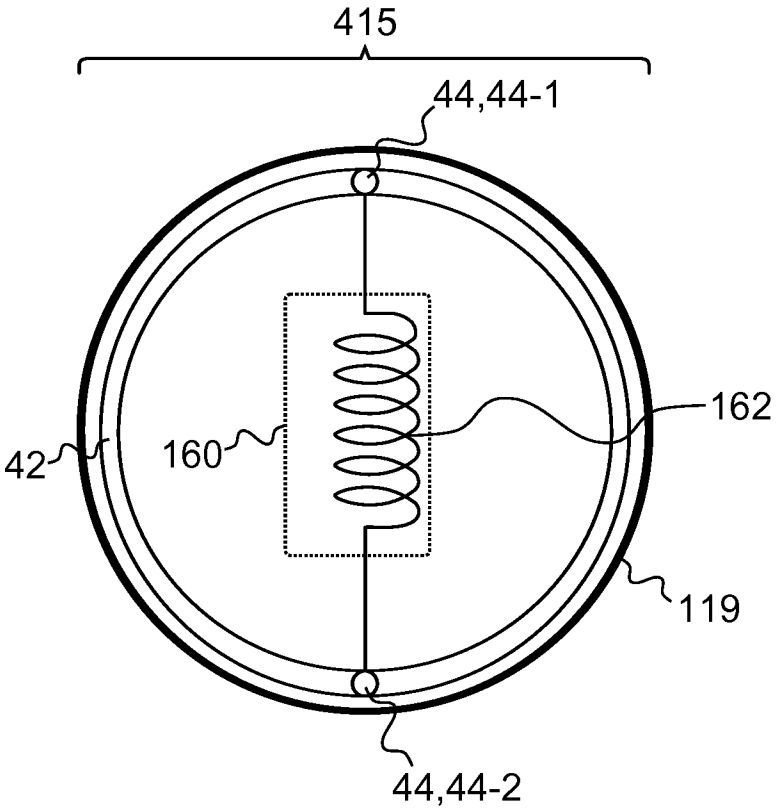
FIG. 11 is a schematic front view of a cross-sectional illustration of the fifth embodiment of a mouthpiece.

In FIG. 11, a schematic front view of a cross-sectional illustration of the fifth embodiment of a mouthpiece 415 is shown. In other words, FIG. 11 shows an insight into the second embodiment of a mouthpiece 415, showing a cross-section of the cylindrical body 119 of the mouthpiece 415, the primary elastic element 42, the secondary heating element 160 realized as a heating wire 162 and the primary contact pins 44-1, 44-2 arranged within the primary elastic element 42. The heating wire 162 is fixed to the primary contact pins 44-1, 44-2 and arranged within the center of the body 119 of the mouthpiece 415 in between the primary contact pins 44-1, 44-2. However, the secondary heating element 160 can also be fixed to other elements or components of the mouthpiece 415 or of the electronic smoking device. Furthermore, other secondary heating elements 160 can be realized within a mouthpiece 415 or an electronic smoking device. Other forms of secondary heating elements 160 may be ceramic heaters or fiber or mesh material heaters. Nonresistance secondary heating elements 160 such as sonic, piezo and jet spray may also be used in the mouthpiece 415 in place of the heating wire 162. Moreover, the secondary heating element 160 can be arranged differently within the mouthpiece 415 or an electronic smoking device, for example extending along a longitudinal direction of the mouthpiece 415 and/or in a distance to the center of the same.

In summary, in one aspect the electronic smoking device comprises a mouthpiece at a first end of the electronic smoking device, the mouthpiece comprising an air inhalation port. The electronic smoking device further comprises an atomizer with a primary heating element. Moreover, the electronic smoking device comprises a liquid reservoir and a secondary heating element which is provided inside the electronic smoking device at the first end of the electronic smoking device.

An advantage may be that such a secondary heating element at the first end of the electronic smoking device near the air inhalation port allows to vaporize droplets of liquid contained within the aerosol which have not been vaporized by the primary heating element. Therefore, such a secondary heating element may increase a user's joy of smoking the electronic smoking device, since no liquid exits the electronic smoking device through the air inhalation port.

In an embodiment, the secondary heating element is arranged between the liquid reservoir and the air inhalation port. An advantage of such an embodiment may be that the energy spent on vaporizing e-liquid is significantly increased.

Furthermore, the liquid reservoir may have a central passage for guiding an aerosol flow to the air inhalation port of the mouthpiece, wherein the secondary heating element is arranged in between the central passage and the air inhalation port. An advantage of that may be that such an arrangement of the secondary heating element in between the air inhalation port and the central passage which extends from the liquid reservoir through the mouthpiece up to the air inhalation port allows an efficient vaporization of last droplets contained within the aerosol since the amount of aerosol passing the secondary heating element is maximized.

In an embodiment, the secondary heating element comprises a heating wire. In an even more preferred embodiment, the secondary heating element comprises a heating wire without a wick. An advantage of that may be that such heating wires are cheap, can simply be heated up and are therefore efficient in heating up an aerosol.

Moreover, the secondary heating element is arranged in the mouthpiece. An advantage of that may be that in such an embodiment, the secondary heating element is arranged close to the air inhalation port which further increases the amount of aerosol passing the secondary heating element, thereby further increasing the efficiency of the vaporization of droplets which remained in the aerosol after having passed the primary heating element.

The mouthpiece may be removable. An advantage of that may be that in such an embodiment, the liquid reservoir of the electronic smoking device can easily be refilled.

The mouthpiece may comprise a member of a press-fit connection, a member of a screw-fit connection or a member of a snap-action connection. In a furthermore preferred embodiment, the housing of the electronic smoking device also comprises a member of a press-fit connection, a member of a screw-fit connection or a member of a snap-action connection which corresponds to the respective member of the mouthpiece. Such members may allow an easy and stable connection of the housing and the mouthpiece.

The mouthpiece may further comprise a primary elastic element extending at least in part along an inner circumference of a body of the mouthpiece. Such a primary elastic element may serve as a fixation means for further components of the electronic smoking device and furthermore additionally may seal the mouthpiece upon fixation of the same to the housing of the electronic smoking device.

In an embodiment, the mouthpiece further comprises primary electrical contact elements which are adapted to electrically connect the secondary heating element to a power source of the electronic smoking device upon fixation of the mouthpiece. An advantage of such an embodiment may be that the secondary heating element is connected to a power source as soon as the mouthpiece is connected to a respective connection portion of the electronic smoking device. Such primary electrical contact elements may increase the safety of the device, since a secondary heating element is not powered when the mouthpiece is removed from the other components of the electronic smoking device.

In a further embodiment, the primary contact elements are arranged within the primary elastic element. In such an embodiment, the fixation of the primary contact elements within the device may easily be achieved and an electrical contacting of the same may safely be performed.

The primary elastic element may have the shape of a ring, wherein the primary contact elements comprise at least two primary contact pins which are arranged on opposing sides of the ring. Preferably, each of the at least two primary contact pins is adapted to electrically connect the secondary heating element to a positive or negative potential of a power source. Such a ring-shaped primary elastic element may provide an extensive sealing of the electronic smoking device when the mouthpiece is mounted.

In an embodiment, the electronic smoking device further comprises secondary electrical contact elements which are electrically connected to the power source and adapted to receive the primary contact elements. Furthermore preferred, the secondary electrical contact elements have a shape which corresponds to the shape of the primary electrical contact elements respectively, providing a form-fit connection for the same. In such an embodiment, the electrical contacting of the secondary heating element may further be simplified.

The electronic smoking device may further comprise a secondary elastic element extending at least in part along an inner circumference of a housing of the electronic smoking device, wherein the secondary electrical contact elements are arranged within the secondary elastic element. Preferably, the secondary elastic element corresponds to the primary elastic element. Furthermore preferred, the secondary elastic element has a shape that is identical to the shape of the primary elastic element. In such an embodiment, the electrical contacting of the primary electrical contact elements may easily be performed and the sealing of the electronic smoking device may further be increased.

The primary heating element and the secondary heating element may be independently operable. In such an embodiment, a user can amend the amount of liquid components which are contained in the aerosol according to his or her personal preferences.

Moreover, a mouthpiece for an electronic smoking device is provided, comprising a body with an air inhalation port therein. The mouthpiece further comprises a secondary heating element which is arranged within the body. Such a mouthpiece may independently be used with several different types of electronic smoking devices.

The mouthpiece may not comprise a liquid reservoir. In such an embodiment, the mouthpiece may be realized as a small and inexpensive component. Furthermore preferred, the mouthpiece has a size which allows the mouthpiece to be fully inserted into the mouth of a user.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

10, 110, 210, 310 electronic smoking device
12 battery portion
14 atomizer/liquid reservoir portion
15, 115, 215, 315, 415, 515, 615 mouthpiece
16 end cap
17-1 member of a press-fit connection
17-2 member of a screw-fit connection
17-3 member of a snap-action connection
18 power source
19, 119, 219, 319 body
20 light emitting diode (LED)
22 control electronics
24 airflow sensor
26 atomizer
27 primary heating element
28 heating coil

30 wick
31 electrical connectors
32 central passage
33 cavity
34 liquid reservoir
36 air inhalation port
38 air inlets
40 first end
42 primary elastic element
43 nozzle
44 primary electrical contact elements
44-1, 44-2 primary contact pins
46 secondary electrical contact elements
46-1, 46-2 secondary contact pins
47 conductive element
48 secondary elastic element
60, 160 secondary heating element
62, 162 heating wire
150, 250 connection portion
221 external thread
223 internal thread
301 retaining lug
302 fixation hole

The invention claimed is:

1. An electronic smoking device comprising:

an atomizer/liquid reservoir portion including:

a liquid reservoir, wherein the liquid reservoir has a central passage for guiding an aerosol flow to an air inhalation port, a primary electrical contact element configured for electrical connection to a power source of the electronic smoking device, and an atomizer with a primary heating element, wherein the atomizer is operatively coupled to the power source; and a mouthpiece that is removable from the liquid reservoir and configured to be located at a first end of the electronic smoking device, the mouthpiece-including the air inhalation port, wherein the mouthpiece further includes:

a wickless secondary heating element located in the mouthpiece and configured to be located between the central passage and the air inhalation port, and a secondary electrical contact element electrically connected to the secondary heating element and configured to be removably electrically connected to the primary electrical contact element.

2. The electronic smoking device of claim 1, wherein the secondary heating element comprises a heating wire.

3. The electronic smoking device of claim 1, wherein the mouthpiece comprises a member of a press-fit connection, a member of a screw-fit connection or a member of a snap-action connection.

4. The electronic smoking device of claim 1, wherein the mouthpiece further comprises an elastic element extending at least in part along an inner circumference of a body of the mouthpiece.

5. The electronic smoking device of claim 4, wherein the secondary contact elements are arranged within the elastic element.

6. The electronic smoking device of claim 5, wherein the elastic element has the shape of a ring and wherein the secondary contact elements comprise at least two contact pins which are arranged on opposing sides of the ring.

7. The electronic smoking device of claim 6, wherein the primary electrical contact elements are adapted to receive the secondary electrical contact elements.

8. The electronic smoking device claim 1, wherein the primary heating element and the secondary heating element are independently operable.

9. A mouthpiece configured for removable attachment to an electronic smoking device, comprising:

a body with an air inhalation port therein, wherein the body is configured to be removable from a liquid reservoir of the electronic smoking device;

a heating element which is arranged within the body; and a secondary electrical contact element electrically connected to the heating element and configured to be removably electrically connected to a primary electrical contact element of the electronic smoking device, wherein the primary electrical contact element of the electronic smoking device is configured for electrical connection to a power source of the electronic smoking device.

* * * * *